US006152691A

United States Patent [19]

Thut

[11] Patent Number: 6,152,691

[45] Date of Patent: Nov. 28, 2000

[54] PUMPS FOR PUMPING MOLTEN METAL

[76] Inventor: Bruno H. Thut, 16755 Park Circle Dr., Chagrin Falls, Ohio 44023-4598

[21] Appl. No.: 09/245,005

[22] Filed: Feb. 4, 1999

[51] Int. Cl.[7] ..... F04D 7/06

[52] U.S. Cl. ..... 415/197; 415/200; 415/206

[58] Field of Search ..... 415/89, 189, 185, 415/196, 197, 200, 206, 905, 178, 173.1, 173.4; 416/241 B

[56] References Cited

U.S. PATENT DOCUMENTS

| | | | |
|---|---|---|---|
| 4,786,230 | 11/1988 | Thut . | |
| 5,597,289 | 1/1997 | Thut . | |
| 5,622,481 | 4/1997 | Thut . | |
| 5,716,195 | 2/1998 | Thut . | |
| 5,951,243 | 9/1999 | Cooper | 415/110 |
| 6,019,576 | 2/2000 | Thut | 415/200 |

OTHER PUBLICATIONS

Brochure, Pump Equation for the Eighties, H.T.S.

*Primary Examiner*—Christopher Verdier

*Attorney, Agent, or Firm*—Watts, Hoffmann, Fisher & Heinke, Co., L.P.A.

[57] ABSTRACT

A nonmetallic pump for pumping molten metal includes a base with an impeller chamber, at least one molten metal inlet opening to the base, at least one molten metal outlet opening from the base, and an impeller connected to one end of a motor driven shaft and rotatable in the impeller chamber. The base includes a shell portion and a one-piece insert formed of nonmetallic heat-resistant material disposed in the impeller chamber. The insert includes a generally circular bore in which the impeller is disposed and a wall extending so as to form a spiral-shaped volute opening around the bore. An egress channel extends from the volute opening toward the molten metal outlet opening. Also included are methods for making the insert and base.

29 Claims, 5 Drawing Sheets

PUMPS FOR PUMPING MOLTEN METAL

TECHNICAL FIELD

This invention relates to pumps for pumping molten metal. More particularly, this invention relates to molten metal pump bases.

BACKGROUND OF THE INVENTION

Pumps commonly used to pump molten metal include transfer pumps and discharge pumps as disclosed in the publication "H.T.S. Pump Equation for the Eighties" by High Temperature Systems, Inc., which is incorporated herein by reference in its entirety.

A transfer pump transfers molten metal out of one furnace to another furnace or into a ladle. In a transfer pump a tubular riser extends vertically upward from the base chamber to the motor mount and contains a passageway for molten metal. Support posts are also provided between the base and the motor mount.

A discharge pump transfers molten metal from one bath chamber through a submerged pipe to another bath chamber. Such a pump typically includes a shaft sleeve and support posts between the base and the motor mount, but has no riser.

As shown in FIG. 1, pumps which employ a base 11 may either be top feed pumps or bottom feed pumps depending, among other things, on the configuration of the base 11 and orientation of the impeller vanes 12 relative to the direction of shaft 17 rotation. Multiple impellers 13 and volute openings 14 may be used, as disclosed in U.S. Pat. No. 4,786,230 to Thut, issued Nov. 22,1988, which is incorporated herein by reference in its entirety.

Pumps used for pumping molten metal typically include a motor carried by a motor mount, a shaft 17 connected to the motor at one end, and an impeller 13 connected to the other end of the shaft 17. Such pumps may also include a base 11 with an impeller chamber 21, the impeller 13 being rotatable in the impeller chamber 21. Support members extend between the motor mount and the base 11 and may include a shaft sleeve 18 surrounding the shaft 17, support posts (not shown), and an optional tubular riser 19. As shown in FIG. 2, a spiral-shaped volute member 20 may be employed in the impeller chamber 21 to form a spiral-shaped volute opening 14 surrounding the impeller 13. During pump operation, the volute opening 14 advantageously produces a higher molten metal outflow pressure than an impeller chamber 21 without a volute opening 14. This is especially important with pumps employing a tubular riser 19 or for pumping high specific gravity molten metals such as zinc or lead. Molten metal is directed from the volute opening 14 to a molten metal outlet 22 or 25 with enough pressure to be expelled at an effective flow rate from the molten metal outlet 22 or 25. In transfer pumps, the pressure created by the volute opening 14 is sufficient to push the molten metal to the outlet 22 and up the entire length of the vertically oriented tubular riser 19. A disadvantage to the use of a separate volute member 20 is that the volute member 20 can become unattached within the impeller chamber 21 and move, thereby affecting molten metal flow through the pump.

Pumps may be designed with pump shaft bearings (not shown), impeller bearings (not shown) and with bearings 23 in the base 11 that surround the impeller to avoid damage of the shaft 17 and impeller 13 due to contact with the shaft sleeve 18 or base 11. The shaft 17, impeller 13, and support members (not shown) for such pumps are immersed in molten metals such as aluminum, magnesium, zinc, lead, copper, iron and alloys thereof The pump components that contact the molten metal are composed of a refractory material such as graphite or ceramic.

The typical base shown in FIGS. 1, 2 and 3 includes the impeller chamber 21, and at least one molten metal inlet 26 and outlet opening 22 or 25. The impeller chamber 21 houses the impeller 13 and generally includes the spiral-shaped volute member 20. An egress channel 27 extends from the impeller chamber 21 toward the molten metal outlet 22 or 25. The impeller chamber 21 of the base 11 may further contain upper (not shown) and/or lower annular bearing rings 23 to prevent damage to the pump components from direct contact of the impeller 13 with the base 11 during operation of the pump. The lower bearing ring 23, for example, may be carried by an annular lower base portion 24 which is cemented to the base around its periphery and may be pinned in place. The lower portion of the impeller 13 is normally generally coplanar with the bottom portion of the base 11 and the bottom portion of the lower annular bearing ring 23. The bearing ring 23, volute member 20 and posts (not shown) are typically cemented in place.

A common problem during operation of molten metal pumps employing a base of this type is the frequency with which catastrophic failure occurs as a result of the volute member 20 and/or annular lower bearing 23 pushing through the bottom of the base. This can occur in top or bottom feed pumps and requires immediate repair. It is believed that the pressure load from the molten metal bath and the molten metal contained in the impeller chamber 21 on the volute member 20 and/or annular lower bearing 23 causes this failure. Repairs of this type are expensive and time consuming and require taking the equipment out of operation.

Manufacturing and construction of a base 11, such as in a transfer pump, typically involves drilling openings through the top and bottom portions of the base 11 for the impeller 13, drilling an opening at the top portion of the base 11 for receiving the shaft sleeve 18 and drilling an opening for a molten metal outlet 22 or 25. If the pump is designed to have a lower annular bearing ring 23, the lower base portion 24 is disposed in a lower opening 29. The lower base portion 24 and the volute member 20 are separately manufactured. The lower base portion 24 is recessed to receive the annular bearing 23. The volute member 20 is spiral-shaped and positioned in the impeller chamber 21 to form a volute opening 14. Extending from the volute opening 14 is an egress channel 27 formed in the base 11. The distal portion of the egress channel 27 extends to the molten metal outlet 22 or 25. The bearing 23, the lower base portion 24 and the volute member 20 are typically cemented into position. In order to complete the egress channel 27 of a transfer pump, labor intensive hammer and chisel work is required to remove the portion of the base shown as 30 in FIGS. 1 and 2 to enable the molten metal inlet 26 to be in communication with the molten metal outlet 22.

SUMMARY OF THE INVENTION

The present invention is directed to a base of a nonmetallic pump for pumping molten metal of the type that receives an impeller carried on a motor driven shaft. In particular, the pump includes a motor fastened to a motor mount; a base having an impeller chamber, at least one molten metal inlet opening to the base; a molten metal outlet opening for the base; a shaft connected to the motor at one end; an impeller connected to the other end of the shaft and rotatable in the impeller chamber; and optional support structure located between the motor mount and the base. The base comprises a one-piece insert formed of nonmetallic heat-resistant material disposed in the impeller chamber. The insert comprises a generally circular bore in which the impeller is disposed, a wall extending so as to form a spiral-shaped volute opening around the bore and an egress channel that can extend from the volute opening toward the molten metal outlet opening. The insert may contain a recess surrounding the generally circular bore for receiving a generally annular bearing ring. The bearing ring is comprised of a refractory material, preferably one of silicon carbide and silicon nitride.

More specifically, the base includes a shell portion having an impeller opening and at least one molten metal outlet opening. The shell portion of the base is configured to receive the one-piece insert. The one-piece insert has a wall extending so as to form the spiral-shaped volute opening around the bore and an egress channel that upon assembly with the shell portion extends to the molten metal outlet opening. The egress channel is generally rectangular shaped and comprised of two elongated planar surfaces of the insert. The egress channel is dimensioned so as to extend to a vertically extending surface forming an opening in the base such that the molten metal inlet, volute opening, egress channel and molten metal outlet are in fluid communication with each other. No labor intensive, time-consuming hammer and chisel work is required to connect the egress channel with the molten metal outlet. The present base can be used in pumps for pumping molten metal such as the transfer pumps and discharge pumps described. In a preferred embodiment at least one pin is inserted through the base and into the insert.

Another embodiment of the invention is directed to a method of assembling a base of a nonmetallic pump for pumping molten metal comprising the steps of positioning a one-piece insert of nonmetallic heat-resistant material into an impeller chamber of the base. The insert comprises a generally circular bore that is configured and arranged to receive an impeller, a wall extending so as to form a spiral-shaped volute opening around the bore and an egress channel that extends outwardly from the volute opening. The egress channel of the insert is in connection (i.e., alignment) with the molten metal outlet opening of the base. The insert is fastened to the base. For example, at least one opening is drilled in the base into the insert and preferably to the impeller chamber. At least one fastener is then inserted into each opening in the base and insert. Cement may be applied between the base and the insert and also between the fastener and base. A generally annular bearing ring may be disposed and cemented into a recess around the impeller opening of the insert.

In another embodiment of the invention, a method of fabricating a nonmetallic heat-resistant base for a pump for pumping molten metal comprises the steps of forming a shell portion and an insert of nonmetallic heat-resistant material. The shell portion is formed by drilling an impeller chamber, a molten metal outlet opening and a lower opening, for receiving the insert. A molten metal transfer conduit, such as a riser, is positioned in a recess formed about the molten metal outlet opening such that fluid communication can occur between the molten metal outlet opening and transfer conduit. The one-piece insert is positioned into the lower opening of the shell portion. The one-piece insert includes a generally circular bore which can receive an impeller, a wall extending so as to form a spiral-shaped volute opening around the bore, and an egress channel extending outwardly from said volute opening. The egress channel of the insert is aligned with the molten metal outlet opening of the shell portion. The insert may have a recess around the bore for receiving an annular bearing ring. The annular bearing ring is cemented in place. The insert is then fastened to the shell portion. Cement is applied between the insert and the base. At least one fastener is inserted into the base and the insert and cemented in place.

Another embodiment is directed to a method of fabricating a nonmetallic heat-resistant pump base for a pump for pumping molten metal comprising the steps of forming a pump base as a shell portion and forming a one-piece insert. The shell portion is formed by drilling a molten metal outlet opening, an impeller chamber and a upper opening of a size for receiving a one-piece insert. A molten metal transfer conduit, such as a riser, is positioned in a recess formed about the molten metal outlet opening such that fluid communication can occur between the molten metal outlet opening and transfer conduit. The one-piece insert formed includes a generally circular bore which can receive an impeller, a wall extending so as to form a spiral-shaped volute opening around the bore, and an egress channel extending outwardly from the volute opening. The one-piece insert is positioned in the upper opening of the shell portion so that the impeller opening of the shell is aligned with the impeller opening of the insert. The egress channel of the insert is then aligned with the molten metal outlet opening of the shell portion and the insert is then fastened to the shell portion.

The present base advantageously overcomes the catastrophic failure associated with volute member and lower annular bearing ring breakthrough of prior art pump bases. The one-piece insert comprises a wall extending so as to form a volute opening and egress channel and may carry a bearing ring, which eliminates the use of a separate volute member and a separate bearing ring to create the volute opening and protect against impact of the pump components. Moreover, the inventive base, by virtue of use of the one-piece insert, no longer requires labor intensive, time-consuming hammer and chisel work to connect the impeller chamber passageway with the molten metal outlet.

Other embodiments of the invention are contemplated to provide particular features and structural variants of the basic elements. The specific embodiments referred to, as well as possible variations and the various features and advantages of the invention will become better understood from the detailed description that follows, when considered in connection with the accompanying drawings.

DETAILED DESCRIPTION OF PREFERRED EMBODIMENTS

Figure 4:
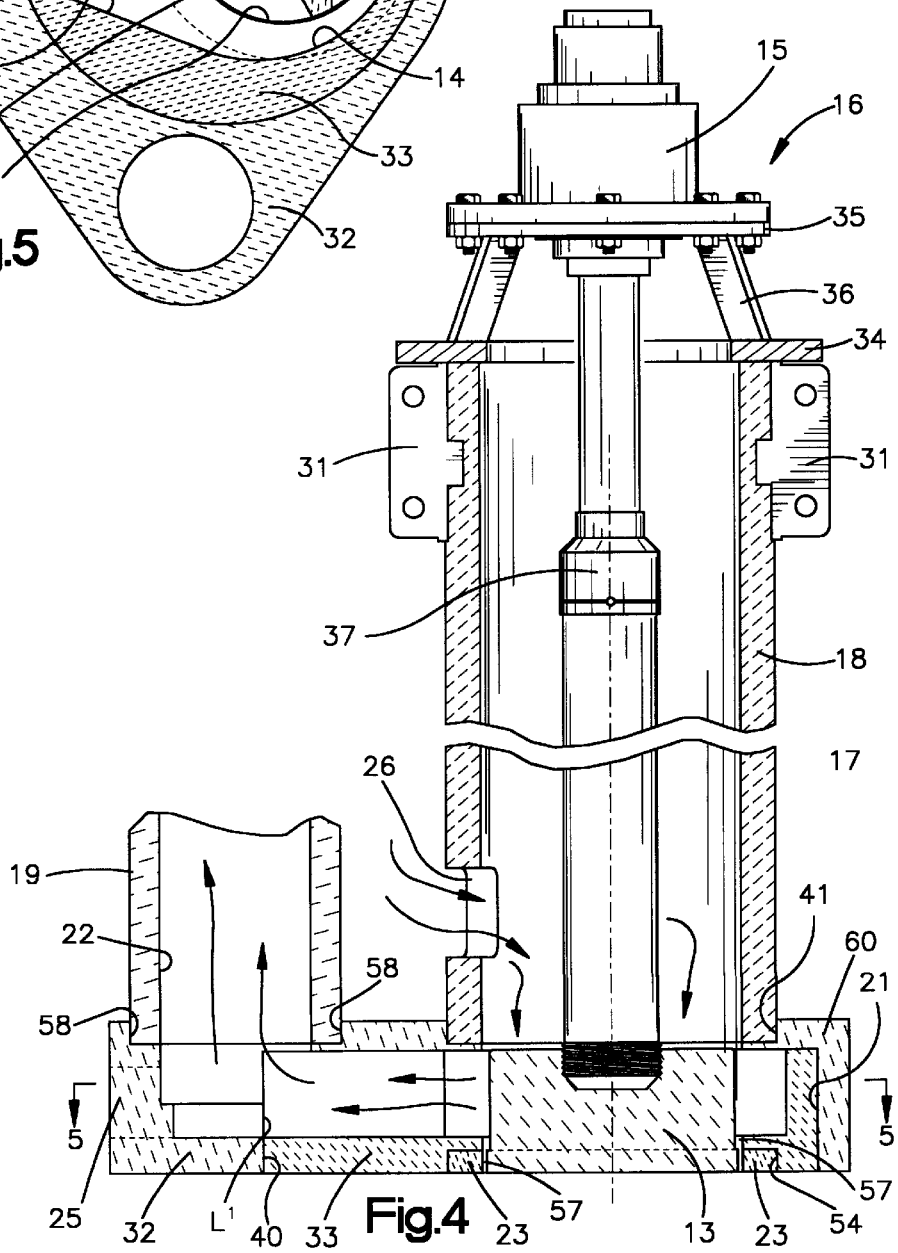
FIG. 4 is a cross-sectional view showing a pump constructed in accordance with the invention.

Referring now to the drawings and to FIG.4 in particular, the illustrated pump is generally designated by reference numeral 10 and is shown as a top feed transfer pump. The pump 10 includes a motor 15 mounted to a motor mount 16. The inventive base 60 has an impeller chamber 21 formed therein. A shaft 17 is connected to the motor 15 at one end. An impeller 13 is connected to the other end of the shaft and is rotatable in the impeller chamber 21. A shaft sleeve 18 preferably surrounds the shaft 17. The shaft sleeve 18 and an optional support post (not shown) are disposed between the motor mount 16 and the base 60. The shaft sleeve 18 and the support post (not shown) have their lower ends fixed to the base 60. A quick release clamp 31 is carried by the motor mount 16. The quick release clamp 31 is of the type described in U.S. Pat. No. 5,716,195 to Thut, issued Feb. 10, 1998, which is incorporated herein by reference in its entirety. The clamp 31 releasably clamps corresponding upper end portions of the shaft sleeve 18 and the support posts (not shown). If only the shaft sleeve 18 is used without support posts, the shaft sleeve 18 may be fastened to the motor mount 16 in a manner known to those skilled in the art. The inventive base 60 shown in FIGS. 5 and 6 preferably includes a shell portion 32 and a one-piece insert 33. However, other modifications and embodiments not shown are contemplated as part of the invention. For instance, the inventive base could include a ring, and an upper plate and lower plate respectively attached to the ring. Openings in the plates would correspond to the openings in the inventive base 60. A selected one of the upper and lower plates would have an integrated wall extending portion so as to form a spiral-shaped volute opening 14 and egress channel 27.

It should be apparent that the base 60 of the invention may be used with any construction of transfer and discharge pump of the types described. Although the invention has been shown used in a top-feed pump, it is also suitably used in a bottom feed pump. In a bottom feed pump construction, the impeller 13 is inverted from the orientation shown in FIG.4 and molten metal enters through a lower opening in the base 60 and axially toward the impeller, after which it is directed radially. Moreover, more than one of the present impellers 13 may be used, such as in a dual volute impeller pump of the type described by U.S. Pat. No. 4,786,230 to Thut.

The motor mount or support 16 may comprise, for example, a flat mounting plate 34 and a motor support portion 35 supported by legs 36 on the mounting plate 34. A hanger (not shown) may be attached to the motor mount for hoisting the pump 10 into and out of the furnace. Other suitable motor mount devices for mounting the motor above the molten metal bath will be apparent to one skilled in the art in view of this disclosure. The motor 15 is an air motor, electric motor or the like.

The shaft 17 is connected to the motor 15 by a coupling assembly 37 which is preferably constructed in the manner shown in U.S. Pat. No. 5,622,481 to Thut, issued Apr. 22, 1997, entitled "Shaft Coupling for a Molten Metal Pump," the disclosure of which is incorporated herein by reference in its entirety. The motor mount 16 shown in FIG. 4 includes an opening in the mounting plate 34, which permits connecting the motor 15 to the shaft 17 by the coupling assembly 37.

The shaft sleeve 18 surrounds and contains the shaft 17. The shaft sleeve 18 extends between the base 60 and the mounting plate 34 and is connected to the base 60 at a corresponding lower portion. The shaft sleeve 18 extends substantially perpendicular to the base 60.

An impeller 13 is connected at the other end of the shaft 17 in the well-known manner, such as by engagement of exterior shaft threads 38 formed on the shaft 17 with corresponding interior threads of the impeller 13. The impeller 13 includes a plurality of vanes 12. An optional impeller bearing ring (not shown) may be used so as to surround a n upper portion of the impeller 13 and is supported by the base 60. There is an annular gap 57 between the annular bearing ring 23 and the impeller 13 or an optional impeller bearing (not shown) to allow for rotation of the impeller 13. The annular bearing ring 23 is employed to prolong the life of the impeller 13 since during vibration the impeller 13 will not strike the base 60, but rather the impeller will strike the upper (not shown) and/or lower annular bearing rings 23. The invention is not limited to any particular impeller construction in this or in the following embodiments and may include vaned impellers, squirrel cage impellers or other impellers used in molten metal pumps. Preferred impeller designs are disclosed in U.S. Pat. No. 5,597,289 to Thut, issued Jan. 28, 1997 and in U.S. patent application Ser. No. 08/935,493 to Thut, which are both incorporated herein by reference in their entireties. As to a suitable squirrel cage impeller that may be used in the present invention, reference may be made to the squirrel cage impeller disclosed in the 08/935,493 application, with or without stirrer openings.

Figure 1:
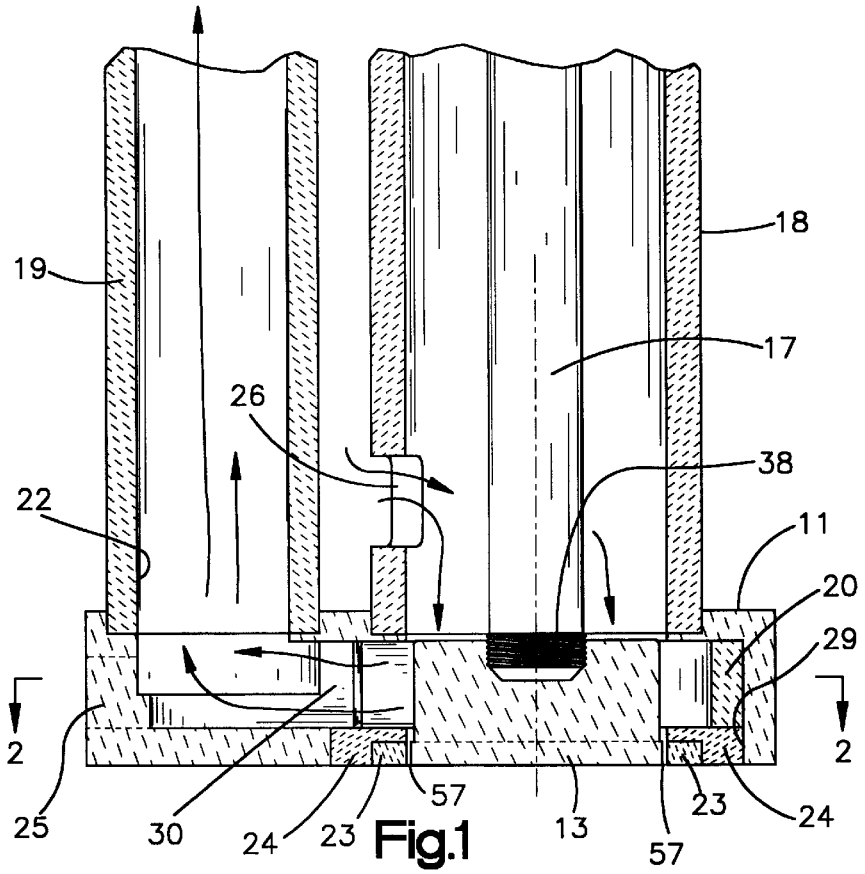
Fig.1 PRIOR ART
FIG. 1 is a vertical cross-sectional view showing a conventional top feed pump.
Figure 2:
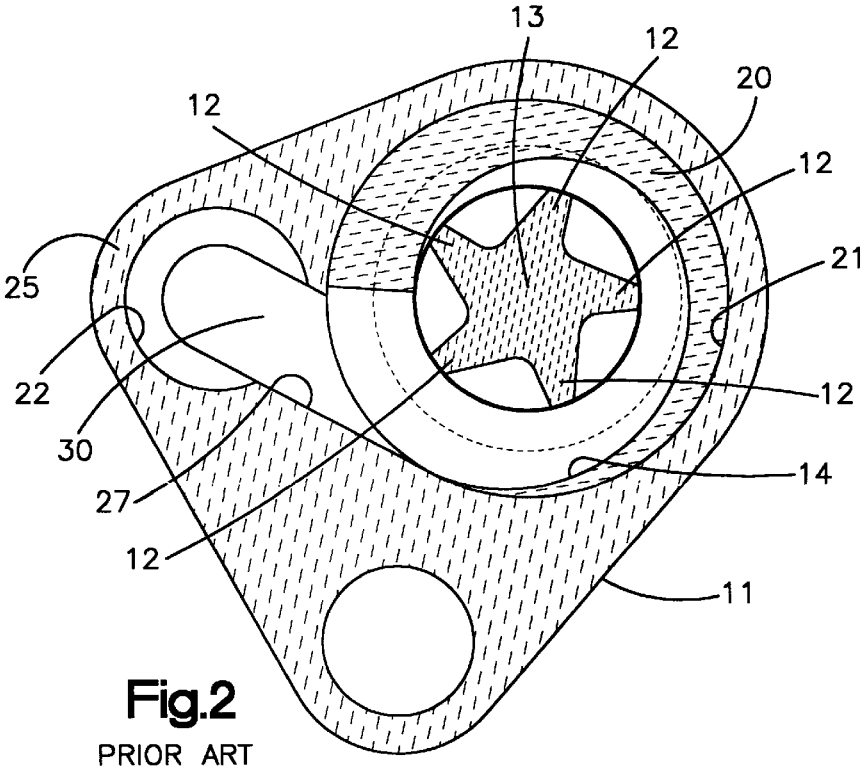
Fig.2 PRIOR ART
FIG. 2 is a cross sectional view as seen from a plane taken along the lines 2—2 of FIG. 1 showing the conventional pump base.
Figure 3:
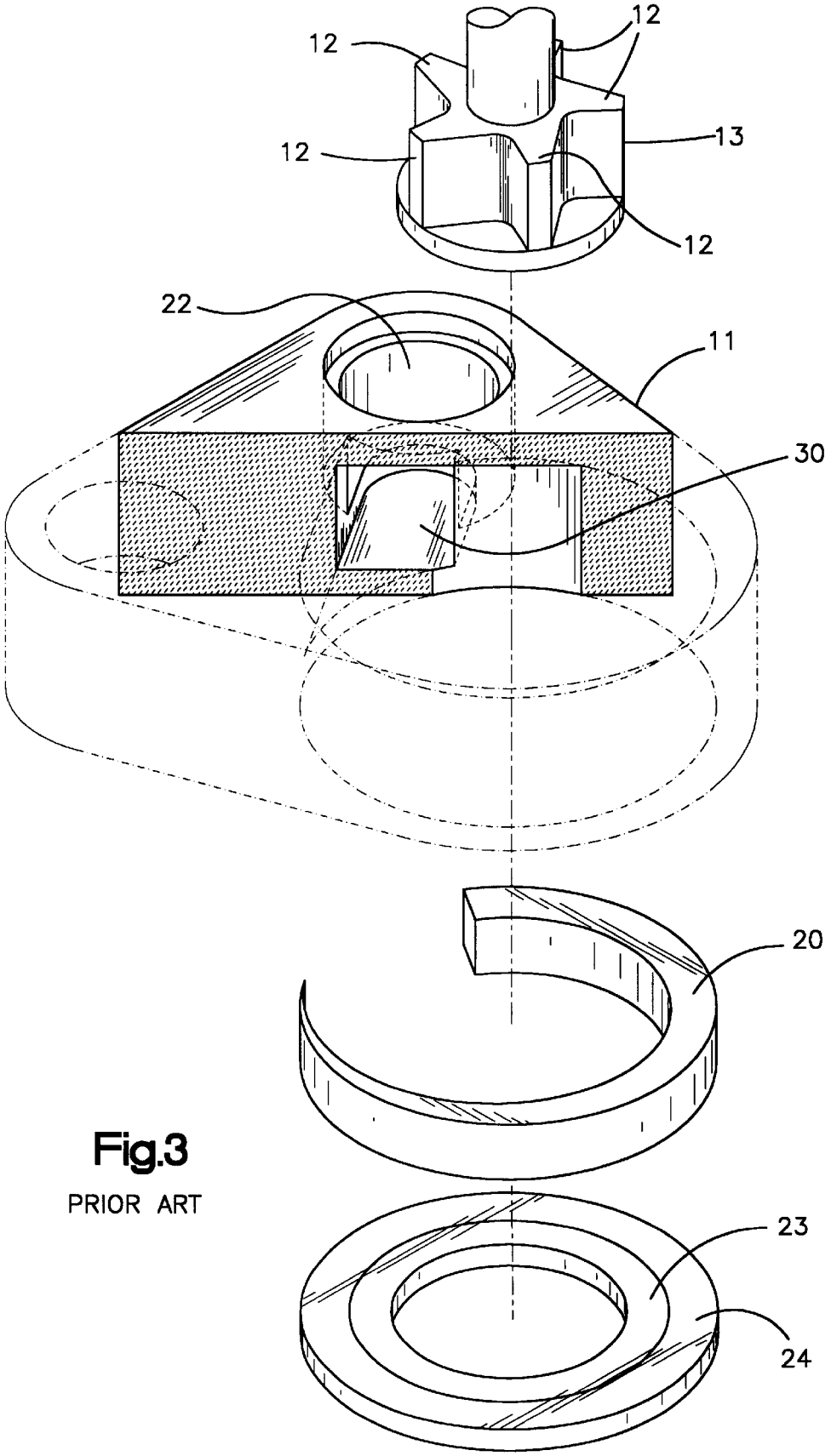
Fig.3 PRIOR ART
FIG. 3 is an exploded perspective view of the conventional base of FIG. 1.
Figure 5:
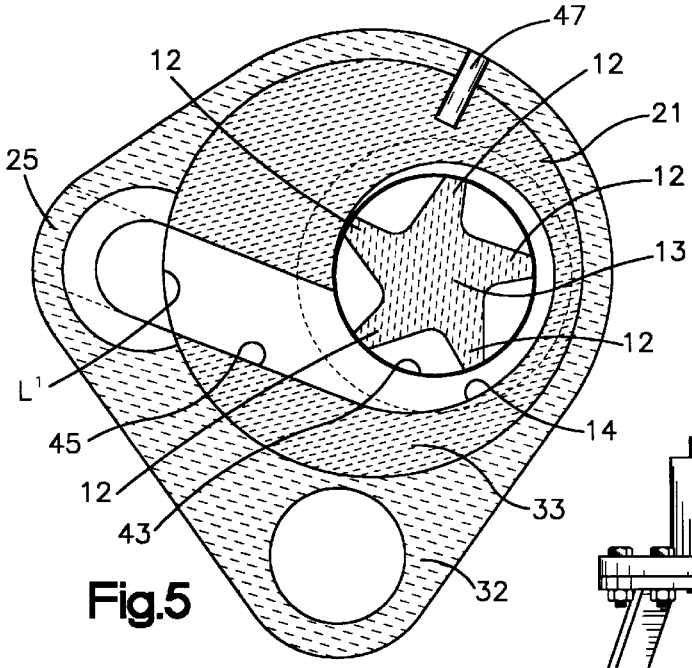
FIG. 5 is a cross-sectional view as seen from a plane taken along lines 5—5 of FIG. 4 showing a pump base.
Figure 6:
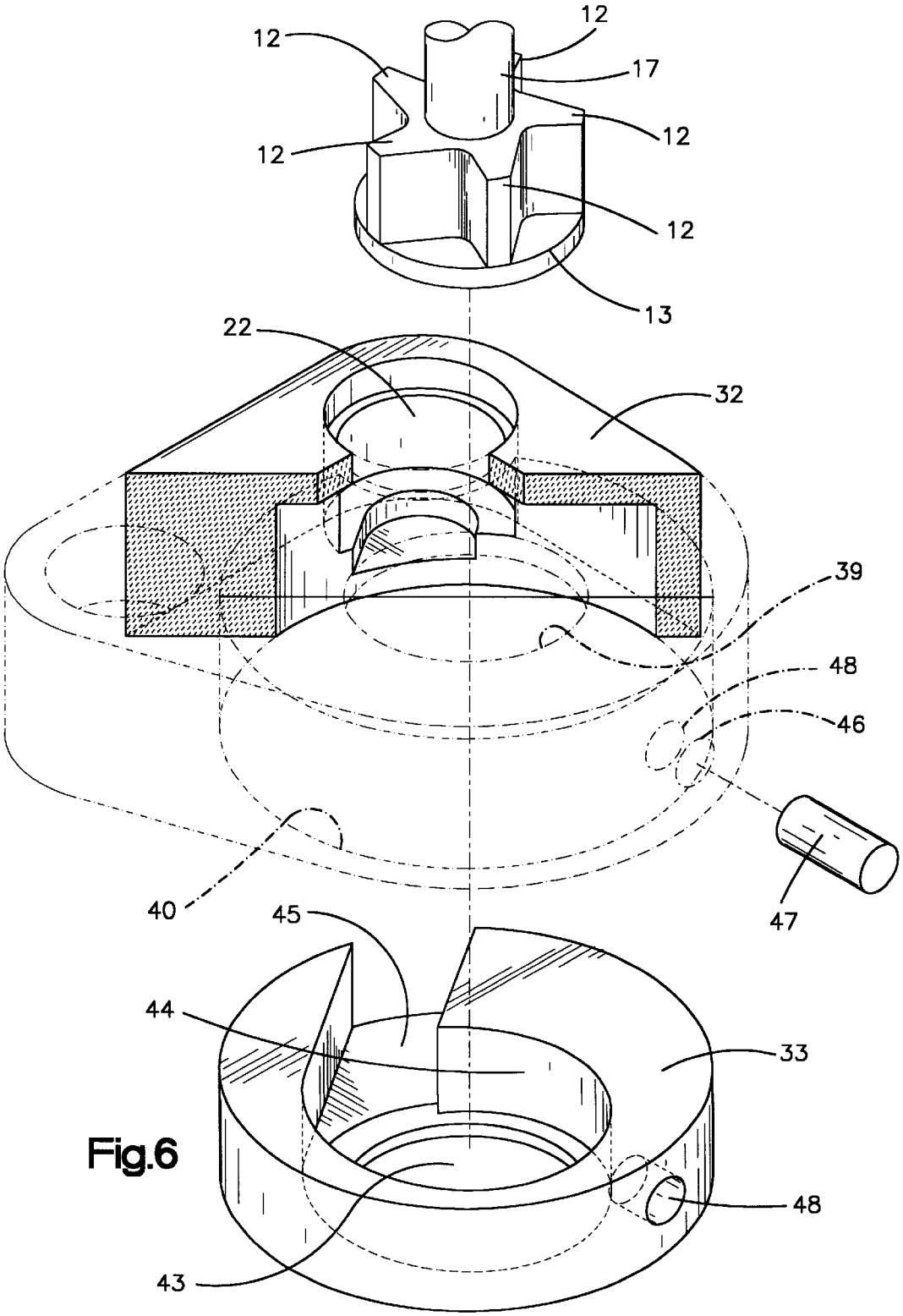
FIG. 6 is an exploded perspective view of the pump base of FIG. 4.

A particularly preferred embodiment of the invention uses the pump shown in FIGS. 4–6 with a bottom inlet (bottom feed) and an inverted squirrel cage impeller as impeller 13. wherein a central opening of the impeller faces downwardly. Although the molten metal inlet openings 26 are unnecessary in this embodiment, the shaft sleeve 18 may include a plurality of smaller openings for relieving pressure therein. The pump shown in FIGS. 7 and 8 may also be used.

As illustrated in FIG. 6, the shell portion 32 of the base 60 includes a bore 39 for receiving the impeller 13, a recess 41 (shown in FIG. 4) around the bore 39 for receiving the shaft sleeve 18, and a lower opening 40. In the case of a bottom feed pump the shaft sleeve 18 need not include the molten metal inlet opening 26. The lower opening 40 is disposed in a lower surface of the base shell 32. The insert 33 is received in the lower opening 40 and may have a recess 42 formed in a lower surface thereof for receiving the bearing ring 23. The bearing ring 23 can be formed of silicon carbide, silicon nitride or other suitable material. The annular bearing ring 23 is cemented in place. The annular bearing ring 23 surrounds an optional impeller bearing (not shown) or the impeller 13. The bearing 23 protects the impeller 13 from impact with the base 60.

The one-piece insert 33 has a bore 43 formed in it for receiving the impeller 13. As seen in FIG. 6, a wall 44 of the insert 33 extends so as to form a spiral-shaped volute opening 14 surrounding the impeller opening 43. An egress channel 45 extends outwardly from the impeller opening 43 preferably up to an outlet opening 22 or 25 and has planar side surfaces S1 and S2. The egress channel 45 is aligned with or extends to the molten metal outlet 22 or 25 as shown in FIG. 5 such that fluid communication exists between the molten metal inlet 26 and the molten metal outlet 22 or 25. The egress channel 45 may extend into axial registry with a riser 19 as shown in FIG. 4, such as by extending at least to the line of reference L. A significant benefit of using a one-piece insert 33 including the volute opening 14 and egress channel 45 is that labor intensive and time-consuming hammer and chisel work are not required to connect the impeller chamber 21 with the molten metal outlet 22 or 25. Moreover, the one-piece insert 33 has a large surface area for cementing to the shell portion 32, which results in increased strength in the connection of the insert 33 to the base 60 thereby avoiding pushing of the volute opening 14 through the base 60 during operation.

The lower opening 40 of the shell portion 32 is sized so as to enable the one-piece insert 33 to be positioned in the impeller chamber 21. The one-piece insert 33 is positioned in the impeller chamber 21 such that fluid communication exists between the molten metal inlet 26 and the molten metal outlet 22 or 25. The one-piece insert 33 is positioned in the impeller chamber 21 defined by the shell portion 32 to provide fluid communication between the molten metal inlet 26 and the molten metal outlet 22 or 25. The one-piece insert 33 is cemented in place in the shell 32. Openings 46, 48 are made through the sidewall of the shell portion 32 of the base 60 and extend at least partially into the one-piece insert 33 of the base 60. The openings 46 preferably extend all the way into the bore 40 of the insert 33. Fasteners such as screws (not shown) or pins 47 with or without fastener portions are disposed through the shell 32 and insert 33 into the bore 40 where they may be trimmed flush with the insert 33. Optionally, use of self-drilling screws may be possible. The pins 47 are preferably cemented in place.

Figure 7:
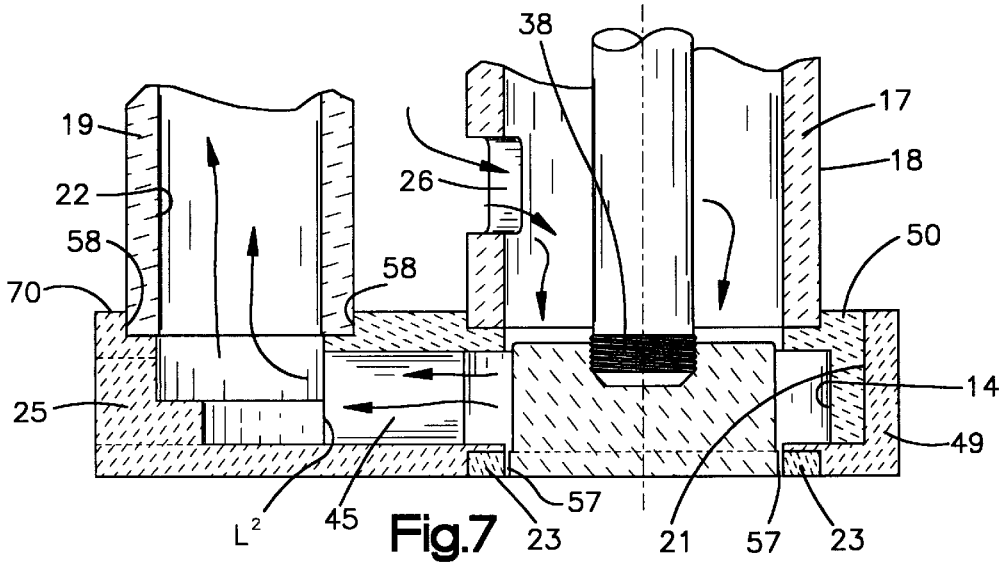
FIG. 7 is a cross-sectional view of a pump employing a base constructed in accordance with the present invention.
Figure 8:
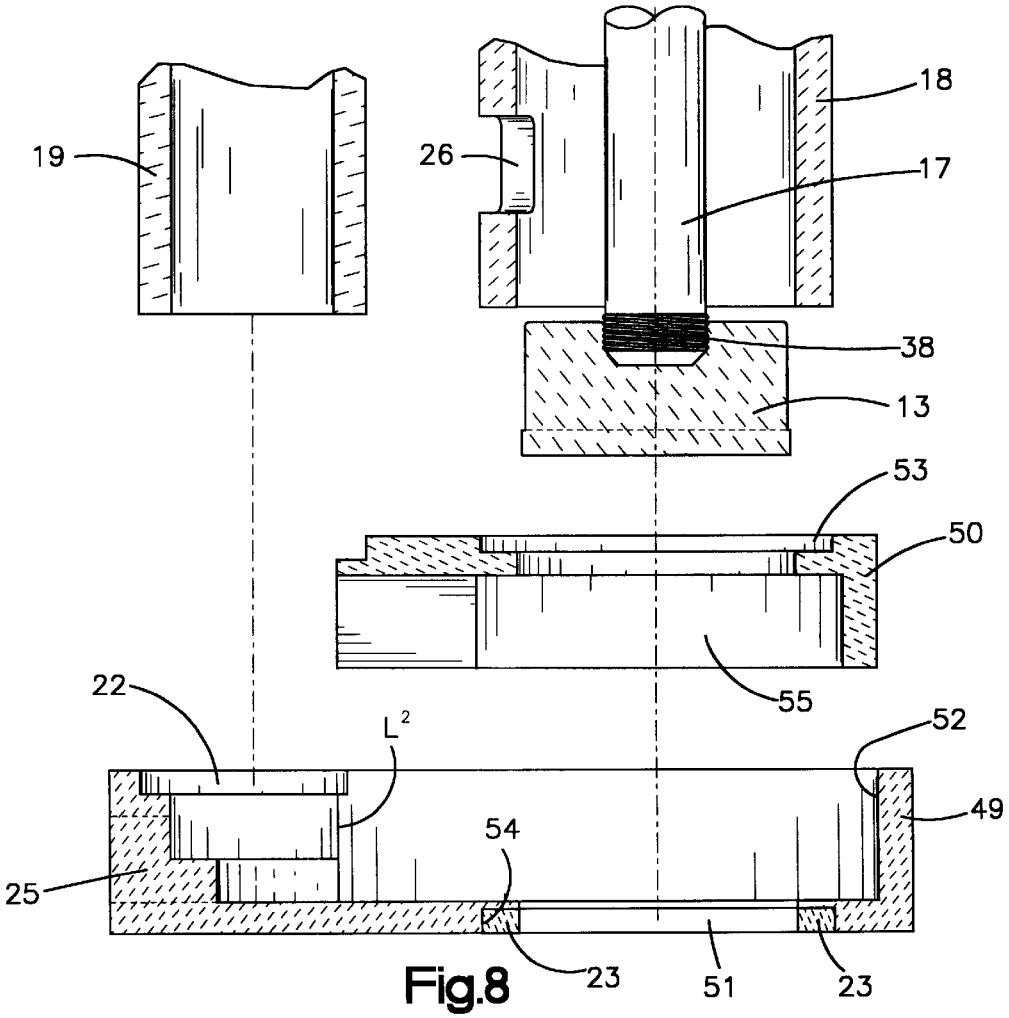
FIG. 8 is an exploded cross-sectional view of the pump of FIG. 7.

Alternatively, the base components can be inverted as shown in the inventive base 70 of FIGS. 7 and 8. The shell portion 49 of the base 70 includes a bore 51 for receiving the impeller 13 and an upper opening 52 for receiving a one-piece insert 50. The upper opening 52 is located in an upper surface of the base shell 49. The one-piece insert 50 is received in the upper opening 52 of the shell 49 and may have a recess 53 formed in the upper surface thereof for receiving the shaft sleeve 18. A lower portion of the shell 49 can be recessed at 54 to receive an annular bearing ring 23. The bearing ring 23 can be formed of silicon carbide, silicon nitride or other suitable material. The bearing ring 23 is cemented in place. The annular bearing ring 23 may surround an optional bearing on the impeller (not shown) or the impeller 13. The bearing 23 protects the impeller 13 from impact with the base 70.

The upper opening 52 of the shell portion 49 enables the one-piece insert 50 to be positioned in the impeller chamber 21. The one-piece insert 50 is positioned in the impeller chamber 21 defined by the shell portion 49 to provide fluid communication between the molten metal inlet 26 and the molten metal outlet 22 or 25 partially defined by the insert 50 and the shell portion 49. The one-piece insert 50 is cemented in place in the shell 49. The openings 46, 48 are made through the sidewall of the shell portion 49 of the base 70 and extend at least partially into the one-piece insert 50 of the base 70. The openings 46, 48 preferably extend all the way into lower opening 55 of the insert 50. The fasteners such as graphite pins 47 are disposed through the shell 49 and insert 50 into the lower opening 55 where they may then be trimmed flush with the insert 50 and are preferably cemented in place.

The one-piece insert 50 of the base 70 has a bore 56 for receiving the impeller 13. The bore or impeller opening 56 of the one-piece insert 50 is aligned with the first opening 51 of the shell portion 49 of the base 70. A wall (not shown) of the insert 50 extends so as to form a spiral-shaped volute opening 14 (as in FIG. 5) surrounding the impeller opening 56. An egress channel 45 extends outwardly from the volute opening 14 preferably to the outlet opening 22 or 25. The egress channel 45 is aligned with the molten metal outlet 22 or 25 as shown in FIG. 7 such that fluid communication exists between the molten metal inlet 26 and the molten metal outlet 22 or 25. The egress channel 45 may extend into axial registry with the riser 19 as shown in FIG. 7.

Manufacturing and construction of the base 60 includes forming a shell portion 32 and an insert 33. In forming the shell portion 32, an impeller chamber 21, a molten metal outlet opening 22 or 25, an impeller opening 39 in an upper surface and a lower opening 40 for receiving the insert 33 are drilled into a block of nonmetallic heat resistant material such as graphite. A recess 58 is drilled around the molten metal outlet 22 for receiving a molten metal transfer conduit, such as a riser 19. A recess 41 is drilled around the impeller opening 39 for receiving a shaft sleeve 18. In forming the one piece insert 33, a generally circular bore 43 which can receive an impeller 13 is drilled in a block of nonmetallic heat resistant material, such as graphite. The outer surface of the insert 33 is dimensioned so as to fit in the lower opening 40 of the shell portion 32. A spiral-shaped volute opening 14 is drilled about the bore 43. An egress channel 45 extending outwardly to a distance $L^1$ is drilled from the volute opening 14. The one-piece insert 33 is positioned in the lower opening 40 of the shell portion. The egress channel 45 is aligned with the molten metal outlet opening 22 or 25 of the shell portion 32. The insert 33 may have a recess 54 around the bore 43 for receiving an annular bearing ring 23. The annular bearing ring 23 is cemented in place. The insert 33 is fastened to the shell portion 32. Cement is applied between the insert 33 and the base 32. At least one fastener 47 is inserted into an opening 46 in the shell portion 60 and an opening 48 in the insert and cemented in place.

Manufacturing and construction of the base 70 includes forming a shell portion 49 and an insert 50. In forming the shell portion 49, an impeller chamber 21, a molten metal outlet opening 22 or 25, an upper opening 52 for receiving the insert 50 and an impeller opening 51 in the lower surface are drilled into a block of nonmetallic heat resistant material such as graphite. The shell portion 50 may have a recess 54 around the impeller opening 51 for receiving an annular bearing ring 23. The annular bearing ring 23 is cemented in the recess 54. In forming the one piece insert 50, a generally circular bore 56, which can receive an impeller 13 is drilled in a block of nonmetallic heat resistant material, such as graphite. A recess 53 is drilled in the upper surface of the insert 50 around the bore 56 for receiving a shaft sleeve 18. The outer surface of the insert 50 is dimensioned to fit in the upper opening 52 of the shell portion 49. A spiral-shaped volute opening 14 is drilled about the bore 56 in the lower surface of the insert 50. An egress channel 45 extending outwardly to a distance $L^2$ is drilled from the volute opening 14. The one-piece insert 50 is positioned in the upper opening 52 of the shell portion 49. The egress channel 45 is aligned with the molten metal outlet opening 22 or 25 of the shell portion 49. A recess 58 is drilled around the molten metal outlet 22 for receiving a molten metal transfer conduit, such as a riser 19. The insert 33 is fastened to the shell portion 32. Cement is applied between the insert 33 and the base 32. At least one fastener 47 is inserted into an opening 46 in the shell portion 60 and an opening 48 in the insert and cemented in place.

Any suitable refractory cements may be used to cement the pins and insert in place For instance, standard refractory cements such as those sold under the trade name SUPER CHIEF by North American Refractories, may be used.

In operation, the molten metal pump 10 is lowered into the molten metal and secured in place. The motor 15 is activated to rotate the shaft 17 via the coupling assembly 37. Rotation of the shaft 17 rotates the impeller 13 in the molten metal. Centrifugal forces caused by rotation of the impeller 13 in the impeller chamber 21 cause molten metal to enter the pump through the inlet opening 26, into the impeller chamber 21 and to the molten metal outlet 22 or 25. In the impeller chamber 21, molten metal is directed through the volute opening 14 to the egress channel 45 and through the molten metal outlet 22 or 25. If molten metal is directed to the opening 22 it has enough pressure that it travels vertically through the riser 19. Otherwise, in a discharge pump the molten metal leaves the base 60 or 70 through the outlet opening 25.

The foregoing description of the preferred embodiments of the invention have been presented for purposes of illustration and description. It is not intended to be exhaustive or to limit the invention to the precise forms disclosed. Obvious modifications or variations are possible in light of the above teachings. The embodiments were chosen and described to provide the best illustration of the principles of the invention and its practical applications to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A one-piece insert for a base of a pump for pumping molten metal, said insert being formed of nonmetallic heat-resistant material and comprising a generally circular bore that can receive an impeller, a wall extending so as to form a spiral-shaped volute opening around the bore, and an egress channel that extends outwardly from said volute opening.

2. The insert of claim 1 comprising a generally annular recess disposed around said bore.

3. The insert of claim 2 comprising a generally annular bearing ring disposed in said recess.

4. The insert of claim 3 wherein said bearing ring is comprised of one of silicon carbide and silicon nitride.

5. The insert of claim 1 wherein said channel is generally rectangular shaped.

6. The insert of claim 1 wherein said channel is dimensioned so as to extend to a vertically extending surface forming an opening in the base.

7. The insert of claim 1 wherein said channel is comprised of two elongated planar surfaces of said insert.

8. In a nonmetallic pump for pumping molten metal including a motor, a base with an impeller chamber, at least one molten metal inlet opening to the base, a molten metal outlet opening from the base, a shaft connected to the motor at one end, and an impeller connected to the other end of the shaft and rotatable in the impeller chamber, the improvement wherein said base comprises a shell portion and a one-piece insert formed of nonmetallic heat-resistant material disposed in said impeller chamber, said insert comprising a generally circular bore in which the impeller is disposed, a wall extending so as to form a spiral-shaped volute opening around the bore and an egress channel that extends from said volute opening toward said molten metal outlet opening.

9. The improvement of claim 1 comprising at least one pin extending through said base and into said insert.

10. The improvement of claim 1 wherein said egress channel extends outwardly from said volute opening and is of a dimension sufficient to connect to the molten metal outlet opening whereby a continuous passageway exists for molten metal to flow from the molten metal inlet opening to the molten metal outlet opening.

11. The improvement of claim 1 wherein one of said shell portion and said insert comprises a generally annular recess.

12. The improvement of claim 11 comprising a generally annular bearing ring disposed in said recess.

13. The improvement of claim 12 wherein said bearing ring is comprised of one of silicon carbide and silicon nitride.

14. The improvement of claim 1 comprising an opening in said shell portion that is of a configuration and size that can receive said insert.

15. The improvement of claim 1 wherein said support structure comprises a generally vertically extending transfer conduit for molten metal disposed in said molten metal outlet opening.

16. A method of assembling a base of a nonmetallic pump for pumping molten metal comprising the steps of:

positioning a one-piece insert of nonmetallic heat-resistant material into an impeller chamber of said base, said insert comprising a generally circular bore that can receive an impeller, a wall extending so as to form a spiral-shaped volute opening around the bore and an egress channel that extends outwardly from said volute opening;

aligning said egress channel of said insert to extend toward a molten metal outlet opening from the base; and fastening said insert to said base.

17. The method of claim 16 comprising applying cement between said insert and said base.

18. The method of claim 16 comprising inserting at least one fastener into said insert and said base and applying cement between said fastener and at least one of said base and said insert.

19. The method of claim 16 further comprising cementing a generally annular bearing ring in a recess disposed in said insert.

20. A method of fabricating a nonmetallic heat-resistant pump base for a pump for pumping molten metal comprising:

forming a shell portion of nonmetallic heat-resistant material, said shell portion comprising a molten metal outlet opening, an impeller chamber, a lower opening of a size for receiving a one-piece insert and an impeller opening in an upper surface;

positioning said one-piece insert into said lower opening of said shell portion and into said impeller chamber, said insert comprising a generally circular bore which can receive an impeller, a wall extending so as to form a spiral-shaped volute opening around the bore, and an egress channel extending outwardly from said volute opening;

aligning said egress channel of said insert with said molten metal outlet opening of said shell portion; and fastening said insert to said shell portion.

21. The improvement of claim 20 comprising drilling at least one fastener opening into said shell portion and drilling at least one fastener opening into said insert, and inserting a pin into said fastener of said shell portion and into said fastener opening of said insert.

22. The improvement of claim 20 comprising forming a generally annular recess in a lower surface of said insert around said bore.

23. The improvement of claim 22 comprising fastening a generally annular bearing ring in said recess.

24. A method of fabricating a nonmetallic heat-resistant pump base for a pump for pumping molten metal comprising:

forming a shell portion of nonmetallic heat-resistant material, said shell portion comprising a molten metal outlet opening, an impeller chamber, an upper opening of a size for receiving a one-piece insert and an impeller opening in a lower surface;

positioning said insert into said upper opening of said shell portion and into said impeller chamber, said insert comprising a generally circular bore which can receive an impeller, a wall extending so as to form a spiral-shaped volute opening around the bore, and an egress channel extending outwardly from said volute opening;

aligning said egress channel of said insert with said molten metal outlet opening of said shell portion; and fastening said insert to said shell portion.

25. The improvement of claim 24 comprising forming a recess around said bore of said insert for receiving a shaft sleeve.

26. The improvement of claim 24 comprising drilling at least one fastener opening through a sidewall of said shell portion and into said insert, and inserting a pin into said fastener opening.

27. The improvement of claim 24 comprising forming a generally annular recess in a lower surface of said shell portion around said impeller opening.

28. The improvement of claim 27 comprising fastening a generally annular bearing ring in said recess of said shell portion.

29. The improvement of claim 25 comprising positioning a cylindrical conduit in said recess of said insert.

* * * * *

UNITED STATES PATENT AND TRADEMARK OFFICE

CERTIFICATE OF CORRECTION

PATENT NO. : 6,152,691
DATED : November 28, 2000
INVENTOR(S) : Bruno H. Thut

It is certified that error appears in the above-identified patent and that said Letters Patent is hereby corrected as shown below:

Column 9,
Lines 64 and 66, change “1” to -- 8 --;

Column 10,
Lines 5, 13 and 16, change “1” to -- 8 --.

Signed and Sealed this

Tenth Day of June, 2003

JAMES E. ROGAN
*Director of the United States Patent and Trademark Office*